US008316471B2

(12) United States Patent
Pessel et al.

(10) Patent No.: US 8,316,471 B2
(45) Date of Patent: Nov. 27, 2012

(54) MODULAR SYSTEM FOR DISPENSING ACTIVE INGREDIENT FLUIDS TO THE FLUSHING LIQUID OF A TOILET BOWL

(75) Inventors: Frank Pessel, Düsseldorf (DE); Ralph Butter-Jentsch, Langenfeld (DE); Matthias Lüken, Düsseldorf (DE); Volker Vanek, Duisburg (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 715 days.

(21) Appl. No.: 12/521,131

(22) PCT Filed: Aug. 16, 2007

(86) PCT No.: PCT/EP2007/058506

§ 371 (c)(1),
(2), (4) Date: Jun. 25, 2009

(87) PCT Pub. No.: WO2008/080643

PCT Pub. Date: Jul. 10, 2008

(65) Prior Publication Data

US 2010/0005578 A1 Jan. 14, 2010

(30) Foreign Application Priority Data

Dec. 28, 2006 (DE) ..... 10 2006 062 496

(51) Int. Cl.
*E03D 9/04* (2006.01)

(52) U.S. Cl. ..... 4/223

(58) Field of Classification Search ..... 4/222, 223, 4/231, 227.1–227.4
See application file for complete search history.

(56) References Cited

U.S. PATENT DOCUMENTS

| | | | | |
|---|---|---|---|---|
| 3,946,448 | A | 3/1976 | Sioufy | |
| 7,039,960 | B2 * | 5/2006 | Pagani | 4/231 |
| 2004/0068782 | A1 | 4/2004 | Butter-Jentsch et al. | |
| 2004/0107484 | A1 | 6/2004 | Butter-Jentsch et al. | |

FOREIGN PATENT DOCUMENTS

| | | | |
|---|---|---|---|
| DE | 19930362 | C2 | 11/2003 |
| EP | 0775741 | A1 | 5/1997 |
| EP | 0785315 | A1 | 7/1997 |
| EP | 0960984 | A2 | 12/1999 |
| EP | 1334239 | B1 | 1/2006 |

* cited by examiner

*Primary Examiner* — Huyen Le
(74) *Attorney, Agent, or Firm* — Connolly Bove Lodge & Hutz LLP

(57) ABSTRACT

The invention relates to a dispensing device for dispensing active ingredient fluids to the flushing liquid in a toilet bowl. Said dispensing device comprises at least two holders (6, 7) for accommodating respective reservoirs (2, 3), every reservoir (2, 3) having its own outlet opening via which the respective active ingredient fluid (4, 5) can be dispensed to the flushing liquid or to the surroundings of the dispensing device and the reservoirs (2, 3) being protected from flushing liquid entering their interior. At least one outlet opening of the reservoirs (2, 3) is arranged on the bottom when in the working position and a partial amount of the active ingredient fluid is dispensed to the flushing liquid from at least one of the reservoirs (2, 3) during flushing. The interior of at least one of the reservoirs (2, 3) communicates with a distribution element (9, 10) via the outlet opening, an arrangement preventing the free flow of the active ingredient fluid (4, 5) being interposed. One reservoir (2, 3), one holder (6, 7) and one plate-shaped distributing element (9, 10) each form an independently operative, separate metering unit (A, B), the metering units (A, B) of the dispensing device being immobilized in relation to each other by at least one connecting element (11).

12 Claims, 4 Drawing Sheets

MODULAR SYSTEM FOR DISPENSING ACTIVE INGREDIENT FLUIDS TO THE FLUSHING LIQUID OF A TOILET BOWL

RELATED APPLICATIONS

This application is a national stage application (under 35 U.S.C. §371) of PCT/EP2007/058506, filed Aug. 16, 2007, which claims benefit of German application 102006062496.3, filed Dec. 28, 2006.

The invention relates to a system for dispensing at least two active substance fluids into the flushing liquid or into the surroundings of a toilet bowl wherein the active substance fluid is dispensed from modular sectional metering units.

BACKGROUND ART

The term "active substance fluid" means free flowing, i.e. liquid to viscous, optionally gel-like or also pasty or granulated or otherwise pourable preparations of active substances having inter alia a cleaning, disinfecting, deodorizing, bleaching effect (in particular described in DE 199 30 362 A1, as well as in EP 0 775 741 A1 and EP 0 960 984 A2).

Dispensing devices from the prior art are known in various designs under the keyword "WC-baskets", In the first place, dispensing devices for a single active substance fluid are known. The active substance fluid is located there in a storage container that is fixedly arranged or inserted in an exchangeable manner, in a holder and has an outlet opening arranged on the bottom side when the storage container is fitted on the holder.

In a first dispensing device from the prior art for a single active substance fluid, the active substance fluid is added via an actuating element which can be impregnated therewith and can be exposed to the action of the flushing liquid (e.g. an actuating element made of an open-cell foam) (EP 785 315 A1). In this case, the outlet opening of the storage container, once a closure part of the storage container has been pushed out, is largely closed by a sealing element arranged in a fixed manner on the holder, with the result that just a flow path of small cross section is available in order for the active substance fluid to trickle out. The device functions by utilizing the capillary action of the open-cell foam. A similar construction with a ribbed plate for dispersion is also known When using the above mentioned dispensing devices from the prior art, all components that have to end up in the flushing liquid of the toilet bowl have to be comprised together in the active substance fluid. However, some components of active substances are not storage stable together. This is why a multi-chamber dispensing device has already been proposed (EP 0 960 984 A2). This dispensing device from the prior art helps to dispense at least two different or identical solid, gel-like, pasty or liquid media in liquid or aqueous form into a toilet bowl. Located on a holder that can be hung on the rim of the toilet bowl is a container that for storing the media comprises at least two adjacently arranged independent compartments. Each compartment has a dispensing device with a dispensing tube with a liquid inlet end surrounded by a cover and an outlet end from which liquid can flow through the bottom of the container. Both compartments of the holder can be filled up through slit-shaped openings with overflowing flushed water that then escapes as a type of a siphon or overflow through the dispensing tube, taking with it the respective active substance into the toilet bowl. The advantage of separate compartments in the holder is that different media can be employed, which would otherwise harmfully interact with each other when stored together in only one compartment. The consistency of the media in the different compartments can also be different.

In the abovementioned dispensing device, the functional principal of known "WC-baskets" is used, according to which, overflowing flush water flows from above into the compartment that comprises the active substance fluid, dissolves part of the active substance and flows out again from the compartment taking part of the active substance with it. With this there is the problem that the realized siphon effect causes a substantial liquid level to remain in the compartments. The action of the flushing liquid on the active substance fluid in the respective compartment therefore continues, even after the flush cycle has long been terminated. In practice, the consumption of active substance fluid cannot be correctly controlled.

Usually, these types of multi compartment system each have available a discharge opening for an active substance fluid from one of the compartments. Accordingly, there are often either two separately molded compartments each having a discharge opening and joined together in the WC-basket. Alternatively a one-piece storage container can be provided with two compartments and two discharge openings.

With the design of two separate outlet openings, it is often necessary to also provide two dispensing devices that control the discharge of active substance fluid from the storage containers into the flushing liquid of the toilet bowl. Here for example, valve arrangements are known, in which a lever connected to a valve is impinged with flushing water thereby releasing a partial quantity of active substance fluid from one of the storage containers. Other dispensing devices are realized using the capillary effects that are formed between the active substance fluids and appropriately sized discharge channels and thereby prevent a free flow of an active substance fluid out of the storage container.

The components of this type of flushing system are often molded in one piece with special tools and assembled, such that these systems are limited to the release of two active substance fluids. An extension to the release of three active substance fluids for example, can only be realized by an elaborate and costly exchange of the required mold tooling.

Accordingly, an object of the invention is to overcome the described disadvantages from the prior art and to make a dispensing system for at least two active substance fluids, which can be simply and cheaply manufactured and assembled.

SUMMARY OF THE INVENTION

The inventive dispensing system is realized as a construction kit or a modular system, in which the dispensing system consists of individual metering modules or metering units that, depending on the application, can be differently combined and pieced together.

This construction kit principle therefore has the advantage that the inventive dispensing system can be easily assembled. Moreover, by standardizing the metering units and their common fixations, the construction kit principle allows a cheaper production by the use of identical tooling.

Furthermore, the modular concept enables one, two and multi compartments to be produced for WC-rinsers without having to exchange the corresponding mold tooling.

Metering Units

"Metering unit" is understood to mean a device that is suited to store an active substance and to discharge it in the surroundings of a WC (toilet) or into the flushing water of a WC. A metering unit is a module of the inventive dispensing system.

A metering unit for dispensing free-flowing active substances essentially includes a holder in which a storage container can be fixed, wherein the storage container is connected with a flushing plate through an intermediate device that impedes a free flow of the active substance fluids.

A metering unit for dispensing fragrance essentially includes a holder in which a storage container filled with fragrance can be fixed, wherein means for releasing the fragrance are arranged on the storage container.

It is particularly preferred that the metering units are of a standard design, such that they can be easily assembled into a dispensing system. This means that the metering units each consist of the same holders, storage containers and/or flushing plates.

Combination Possibilities

Some conceivable combination possibilities for metering units are listed in the table below.

| Module 1 | Module 2 | Module 3 |
|---|---|---|
| Fluid metering unit | Fluid metering unit | — |
| Fluid metering unit | Fragrance metering unit | — |
| Fluid metering unit | Fluid metering unit | Fluid metering unit |
| Fluid metering unit | Fluid metering unit | Fragrance metering unit |

Additional combinations are of course conceivable, as well as dispensing devices that consist of more than three modules or metering units.

Connector

In the context of this application, a "connector" is each separately molded device or device that is constructed on the units, which is suitable for fastening the units against each other.

In this context, "against each other" means that the units, by being fastened, are brought into a defined, essentially stationary position or location to one another.

The joint can be force fit, interlocking and/or cohesive in nature and can be of a permanent or releasable design.

The connector can be directly molded with or on a unit or be realized from a separate component from the units.

The term "connector" is also understood to mean the cooperation of two or more devices, said cooperation fastening the metering units against one another. Connector is particularly understood to mean the formation of interlocking or force fit cooperating jointing partners that, by their cooperation, ensure a joint or fastening of the metering units against each other and thus, in the scope of this invention, form a connector.

The metering units can be fastened to one another in an interlocking manner for example by means of a snap-on closure, snap-in closure, push-on closure, screw closure, bayonet closure, clamping fastener, crimping joint or press stud.

In another embodiment of the invention, the metering units can also be fastened against one another in a cohesive manner. The cohesive joint can be designed such that on separating the metering units, the cohesive joint is destroyed and can no longer be reproduced. However, the cohesive joint can be designed such that a repeated separation and adhesion of the metering units to one another is possible.

The cohesive joint can be selected for example from the group of adhesive joints, welded joints or sealed joints.

Moreover it is possible to manufacture a permanent or separable joint between the metering units by a positive connection. This can be realized by a press stud joint, frictional joint, clamp joint, crimp connection, shrink connection, key joint, screw connection, pin connection or the like.

Naturally, it is also conceivable that the connector fastens the metering units by a combination of the previously mentioned types of joints.

In regard to an inexpensive production of the inventive dispensing system, it is advantageous to integrally form the connector with a metering unit. The integrally formed or one-piece design of the connector can be realized in one step when the dispensing system is formed by means of suitable shaping processes, particularly by injection molding. In this way, the required steps for finishing and assembling the metering unit and connector in the case of a design involving a plurality of pieces are dispensed with, thereby making the production of the inventive dispensing system significantly more cost efficient.

Consequently it is particularly advantageous to design the units such that they are fastened by a joint between the holder, storage container and/or flushing plate.

For example, the holder can be shaped such that an interlocking joint, such as for example a snap-in connection, snap-on connection, push-fit connection or the like is formed when molding the wall of the holder, such that by assembling two correspondingly designed holders, they are fastened against one another. Thus, the side wall of a first holder can incorporate a groove, into which a tongue of a second holder can be interlockingly inserted, wherein the tongue and groove connection is configured such that the holders are fastened against one another. In this way, any number of metering units, arranged essentially horizontally to each other, can be joined together and fastened against one another such that a corresponding dispensing system is formed.

Of course, it is also possible to design the storage containers and/or the flushing plate in the same way.

Storage Container

In the context of this application, a "storage container" is a container that is suitable for receiving a free-flowing or dispersible product. At least one of the storage containers of the dispensing system disposes of a dispersion opening on the bottom side, through which are discharged the active substance fluids. Particularly preferably, at least two storage containers dispose of a dispersion opening on the bottom side.

It is particularly preferred to form the storage containers in a one-piece design. The storage containers can be separated, at least in sections, from one another by a separation wall. However, it is also conceivable to form the storage reservoirs with a design involving a plurality of pieces.

The storage containers are each preferably designed as complete containers and only connected to one another by at least one, preferably exactly one connecting bar, formed between the storage containers. The connecting bar is preferably integrally molded onto the inner sides of the storage container, which face each other, in particular for example, simultaneously molded with the storage containers in the blow molding process. It is particularly preferred if the connecting bar is located approximately centrally and extends essentially—optionally with interruptions—over the whole length of the storage container.

In another embodiment, it is foreseen that a storage container having an opening on the bottom side is molded on the WC-rinser. The discharge opening on the bottom side can be centrally located or offset from the center of a metering unit.

In particular, the floors can be designed to slope down towards the opening in order to enable a complete emptying of the residual active substance fluid out of the storage containers.

It is particularly preferred that the storage containers are transparent in order that the fill level of the stored active substance fluids can be checked.

Dispensing Device

In the context of this application, a "dispensing device" is a device downstream from the discharge opening of the storage container in the direction of flow of the active substance fluid, which regulates the discharge of the active substance fluid into the flushing liquid.

In this context, "regulates" means that a free flow of the active substance fluid through the dispensing device is prevented, and product is released through the dispensing device in particular directly before, during or after a flush cycle of the toilet.

For example, the discharge can be effected by the surge of the flushing water of the toilet bowl, in that the surge of the flushing water opens a valve arrangement, for example. The dispensing device can also be realized by an arrangement that prevents a free flow of the active substance fluid out of the storage container by, for example capillary action. Reference is made here to the dispensing devices known from EP 1334239 and which are hereby made the subject matter of this application.

Active Substance Fluid

The term "active substance fluid" means free flowing, i.e. liquid to viscous, optionally gel-like or also pasty or granulated or otherwise pourable preparations of active substances having inter alia a cleaning, disinfecting, deodorizing, bleaching action (in particular described in DE 199 30 362 A1, as well as in EP 0 775 741 A1 and EP 0 960 984 A2).

In the context of this application, "different from each other" means that the active substance fluids do not exclusively differ for example in regard to their chemical composition, their pH, color, fragrance, flow properties or the like.

The flow properties of the active substance fluids can be essentially identical or differ from one another. With flow properties that differ from one another, it is possible to prepare different mixing ratios of the active substance fluids.

According to the invention, suitable active substance fluids are, for example, fragrant phases, particularly perfumed fragrant phases. Such fragrant phases usually contain at least one fragrance, preferably perfume oil, at least one surfactant or an emulsifier and water as well as optional further substances such as preservatives, thickeners, sequestering agents, colorants, further surfactants or emulsifiers, stabilizers, descalers, etc.

According to the invention, equally suitable as active substance fluids are bleaching phases, particularly bleaching phases containing chlorine, for example bleaching phases based on hypochlorite, wherein the bleaching phases can usually contain, apart from the actual bleaching agent and water, optional further substances such as thickeners, surfactants or emulsifiers, neutralizers, colorants, fragrances, etc.

Further suitable active substance fluids according to the invention are descaling active substance phases, preferably acidic descaling active substance phases. Such descaling active substance phases can comprise, apart from the actual descaler—this is preferably an organic or inorganic acid—and water, optional further substances such as surfactants or emulsifiers, thickeners, fragrances, preservatives, etc.

It is equally possible to use highly concentrated surfactant phases, "foam boosters", as the active substance fluids. Such highly concentrated surfactant phases can also comprise additional conventional substances in addition to the surfactants.

According to the invention, active substance fluids with an antibacterial and/or fungicidal and/or antiviral active substance phase are likewise suitable, wherein the active substance phase can comprise, apart from the active substance acting antibacterially and/or fungicidally and/or antivirally and water, optional further substances such as, for example, surfactants or emulsifiers, thickeners, fragrances, preservatives, etc.

In addition, it is possible for the active substance fluids to be enzyme-containing active substance phases. Such enzyme-containing active substance phases can comprise, apart from the enzyme(s) and water, optional further substances such as surfactants or emulsifiers, thickeners, fragrances, preservatives, etc.

Equally, it is possible for the active substance fluids used in accordance with the invention to be absorbent, particularly odor-absorbent, active substance phases. They can comprise, apart from the absorbent, especially the odor-absorbent, and water, optional further substances such as surfactants or emulsifiers, thickeners, fragrances, preservatives, etc.

According to a special embodiment, the dispensing device according to the invention offers the possibility of using combinations of different active substance fluids in the storage containers, wherein according to a preferred embodiment, one of the storage containers contains a fragrant phase, particularly as previously defined.

Examples of active substance fluid combinations to be used are perfumed fragrant phases combined with chlorine bleach (not stable in storage together with one another), perfumed fragrant phases with a highly concentrated surfactant phase (foam booster), fragrant phase with a descaling acidic active substance phase, fragrant phase with an antibacterial active substance phase, different acid systems, fragrant phases combined with an enzyme-containing active substance phase, perfumed acid phases combined with a water-coloring phase, fragrant phases with an odor-absorbent phase, perfumed acid phases with active oxygen, perfumed acid phases with an active substance phase, thickened with polyacrylate, etc. Of particular interest in that case are viscous to gel-like active substance fluids with viscosities in the region of a few thousand mPas, particularly from 2000 to 5000 mPas, preferably 2500 to 3500 mPas (measured by RotoVisko LVTV II, spindle 31, 5 rpm, 20° C.).

For the purpose of the disclosure of the present patent application, reference is made to the whole contents of the previously published text DE 20116963 and the disclosure of the contents of which are included by reference in the contents of the disclosure of the present patent application. Reference is particularly made to the disclosure in this previously published text in regard to the active substance fluids and combinations of active substance fluids to be used in the storage containers. Also, the present dispensing device that will be described below can be employed in a particularly advantageous way with the active substance fluids and combinations of active substance fluids from the prior art.

DESCRIPTION OF THE DRAWINGS

The invention is illustrated below in more detail with illustrative drawings of a sole embodiment. Particularly preferred developments and particularly preferred combinations of characterizing features will also be described below in detail. In the drawings.

REFERENCE NUMERALS

| | |
|---|---|
| 1. | WC-rinser |
| 2. | Storage container |
| 3. | Storage container |
| 4. | Active substance fluid |
| 5. | Active substance fluid |
| 6. | Holder |
| 7. | Holder |
| 8. | not used |
| 9. | Dispersion element |
| 10. | Dispersion element |
| 11. | Connector |
| 12. | Opening |
| 13. | Clip |
| A. | Metering unit |
| B. | Metering unit |

DESCRIPTION OF EMBODIMENTS

Figure 1:
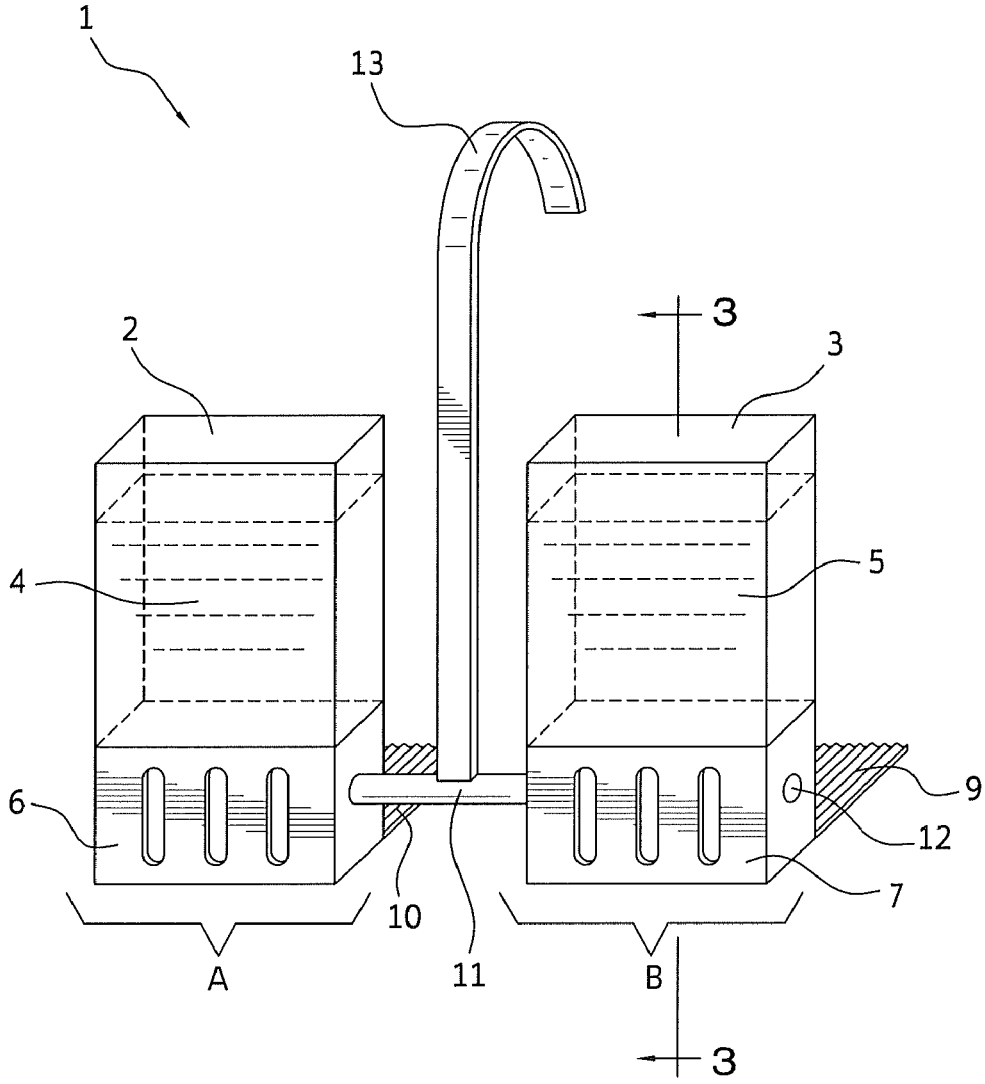
FIG. 1 shows a WC-rinser with connecting element between the holders.

FIG. 1 shows a WC-rinser 1 with a first storage container 2 and a second storage container 3. The storage containers 2, 3 are each filled with different active substance fluids 4, 5. The storage containers 2, 3 have an opening on the bottom side, which is masked by the holder 6, 7 in FIG. 1.

The preferably transparent storage containers 2, 3 are preferably detachably fixed in the holders 6, 7 provided for them. It is particularly preferred that the holders 6, 7 and the storage containers 2, 3 are designed such that when the latter (2, 3) are emptied they can be removed from the holders 6, 7 and can be replaced by new, filled storage containers 2, 3.

The storage containers 2, 3 that are fixed in the holders 6, 7 are protected against an entry of flushing liquid from the WC-flush (toilet flush).

Figure 3:
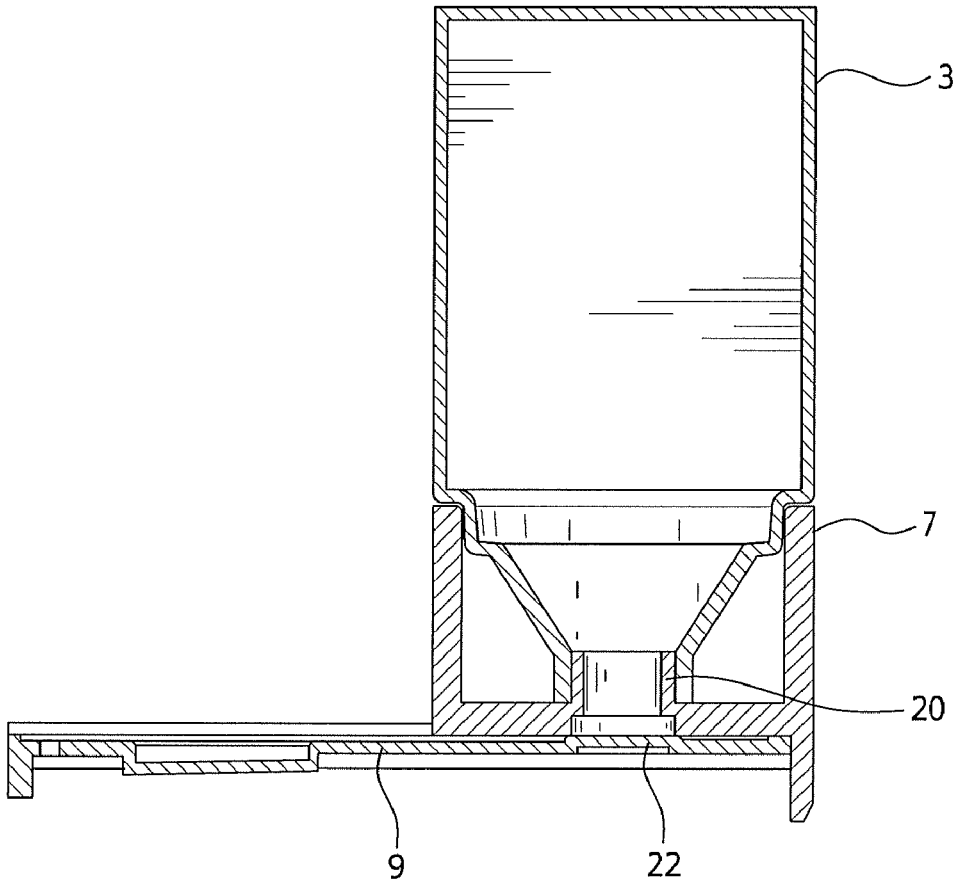
FIG. 3 is a cross-sectional view taken along line 3-3 of FIG. 1.
Figure 4:
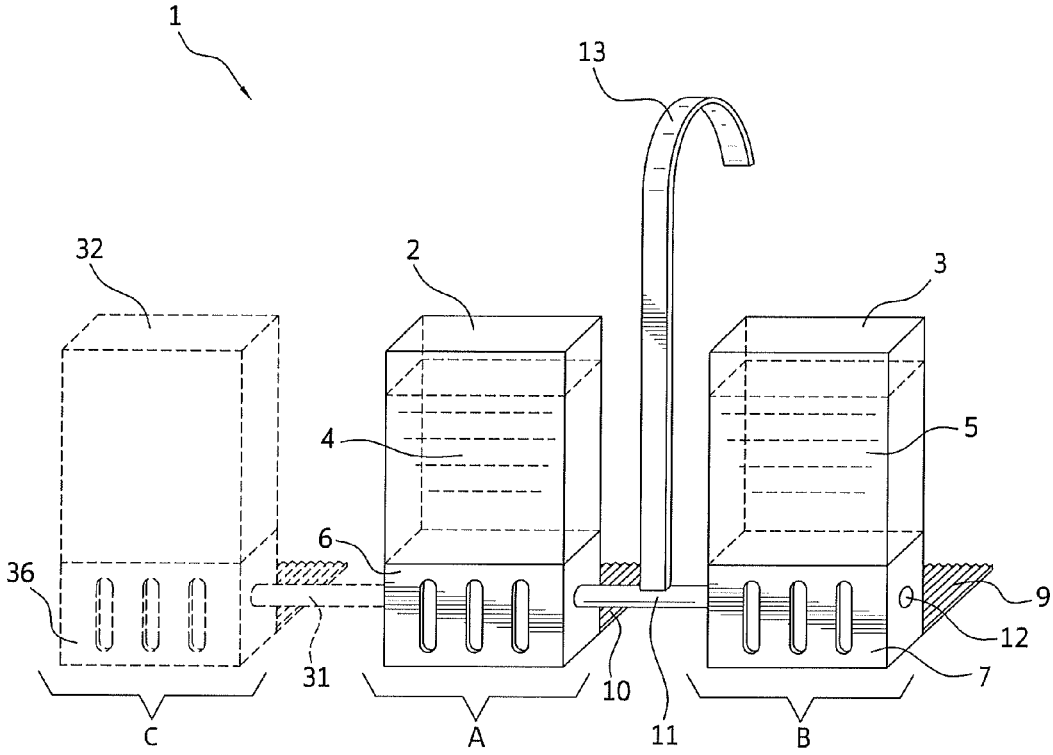
FIG. 4 shows a WC-rinser with connecting element between the holders, with a third storage container.

In FIGS. 1, 3 and 4, a dispensing device 22 that prevents a free flow of the active substance fluid 4, 5 out of the storage container 2, 3 is arranged between the discharge opening 20 on the bottom side of the storage container 2, 3 and the plate-shaped dispersion element 9, 10. The dispensing device can be, for example controlled by a valve or be realized by an arrangement that prevents a free flow of the active substance fluid 4, 5 by, for example capillary action.

Each dispensing device is connected to a plate-shaped dispersion element 9, 10, such that the active substance fluids 4, 5 from the dispensing device can reach the flush plates 9, 10, where they are impinged with flushing liquid, dissolved and swept away together.

The first storage container 2, the first holder 6 and the first dispersion element 9 form the first metering unit A, whereas the second storage container 3, the second holder 7 and the second dispersion element 10 form the second metering unit B. In particular, the storage containers 2, 3, the holders 6, 7 and the dispersion elements 9, 10 of the first and second metering units A, B are essentially identically constructed.

The first metering unit A and the second metering unit B are fastened against one another by the connection element 11. The connection element 11 is shaped like a pin that can be inserted into the opening 12 of the holder 6, 7 and forms an interlocking, force-fit and/or cohesive joint with the opening. The pin-shaped connector can be integrally molded on one of the holders 6, 7 or can be provided as a separate component that is connected with the first holder 6 and the second holder 7.

A clip 13 is attached to the connection element 11 and serves to fasten the assembled dispensing device 1 onto the rim of a toilet bowl.

Figure 2:
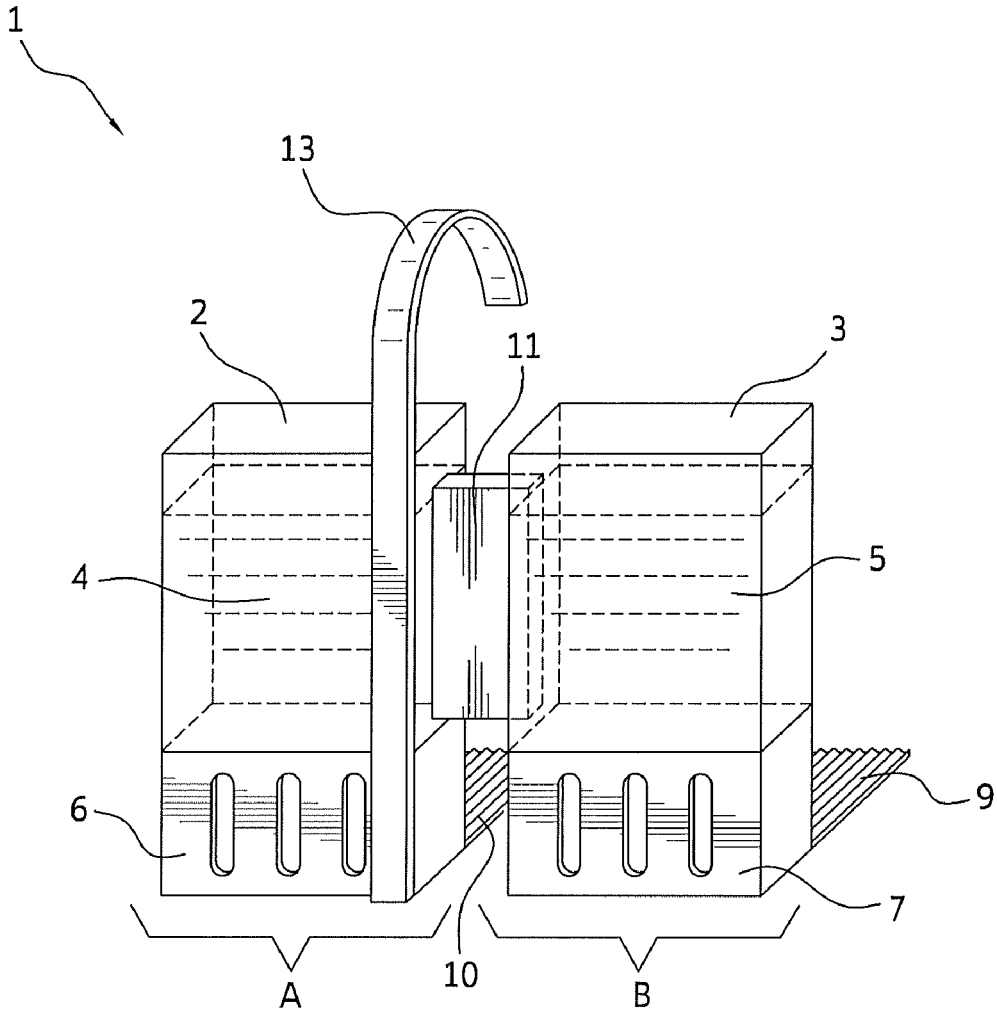
FIG. 2 shows a WC-rinser with connecting bar on the storage containers.

FIG. 2 shows another embodiment of the invention, in which the connection element 11 for fastening the metering units A, B is formed by a bar between the storage containers 2, 3. In this case, the storage containers 2, 3 are preferably integrally formed, for example by a blow molding process, such that the bar-shaped connection element 11 is integrally molded with the storage containers 2, 3.

The clip 13 for fastening the dispensing device 1 onto the rim of the toilet bowl is integrally molded with the first holder 6.

Needless to say, the invention is not limited to the illustrated embodiment. Further developments are possible without leaving the ambit defined in the claims.

A third metering unit C is shown in phantom outline in FIG. 4. Such third metering unit is linked in series with the first metering unit and the second metering unit by connector 31. The third metering unit includes a storage container 32 and a holder 36.

The invention claimed is:

1. A dispensing device for dispensing at least one active substance fluid into flushing liquid in a toilet bowl during a flush cycle, comprising:

a first metering unit (A) of a first holder (6) that receives a first storage container (2) that defines a first discharge opening through which a first active substance fluid (4) can be discharged into the flushing liquid or surroundings of the dispensing device, wherein the first discharge opening when in functional position is located at a bottom side of the first storage container;

a second metering unit (B) of a second holder (7) that receives a second storage container (3) that defines a second discharge opening through which a second fluid (5) can be discharged into the flushing liquid or surroundings of the dispensing device, wherein the interior of at least one of the storage containers (2, 3) is connected with a plate-shaped dispersion element (9, 10) through the first or second discharge opening and a dispensing device (22) that prevents a free flow of the first active substance fluid (4) or second fluid (5), and wherein during the flush cycle, a partial quantity of the first active substance fluid or second fluid is discharged from at least one of the storage containers (2,3) into the flushing liquid; and at least one connection element (11) comprising a snap-on closure or crimp connection fastening the first and second metering units (A, B) to one another by connecting the holders (6, 7), the storage containers (2, 3) and/or the dispersion element (9, 10).

2. The dispensing device according to claim 1, wherein the connection element (11) is formed as a pin on the first metering unit (A) and cooperates with an opening (13) of the second metering unit (B) through a force fit, interlocking and/or cohesive connection, and fastens the metering units (A, B) against one another.

3. The dispensing device according to claim 2, wherein the connection element (11) is integrally formed with the first metering unit (A).

4. The dispensing device according to claim 1, wherein the first active substance fluid (4) is a different composition from the second fluid (5).

5. The dispensing device according to claim 1, comprising at least one metering unit for dispensing an active substance fluid (4) into the flushing liquid, and further comprising at least one metering unit for dispensing fragrance into the surroundings of the dispensing system.

6. The dispensing device according claim 1, wherein each holder (6, 7) that receives a storage container (2, 3) filled with active substance fluid (4) or fluid (5) is provided with a separate, plate-shaped dispersion element (9, 10) comprising an area that is impacted and inundated during the flush cycle.

7. The dispensing device according to claim 1, wherein the storage containers (2, 3), the holders (6, 7) and the dispersion elements (9, 10) of the first and second metering units (A, B) are essentially identically constructed.

8. The dispensing device according to claim 1, wherein both interiors of the storage containers (2, 3) are connected with a respective dispersion element (9,10) through the respective discharge opening and dispensing device (22) that prevents a free flow of the active substance fluid (4) and fluid (5).

9. The dispensing device according to claim 1, further comprising a third metering unit connected by a second connection element to one or both of the first metering unit and the second metering unit.

10. The dispensing device according to claim 1, wherein second fluid (5) is an active substance fluid.

11. A device for dispensing a fluid into flushing liquid of a toilet bowl during a flush cycle, comprising:

a first metering unit having a first holder and a first storage container for storing an active substance held by said first holder, said first holder defining a first discharge opening through which the active substance may be discharged;

a second metering unit having a second holder and a second storage container for storing a second active substance or a fragrance held by said second holder, said second holder defining a second discharge opening through which the second active substance or fragrance may be discharged;

a first plate-shaped dispersion element through the first discharge opening and onto which a partial quantity of the active substance is discharged from the first storage container and into the flushing liquid;

a second plate-shaped dispersion element through the second discharge opening and onto which a partial quantity of the second active substance or fragrance is discharged from the second storage container and into the flushing liquid; and at least one connection element formed as a pin on the first metering unit and cooperating with an opening of the second metering unit through a force fit, interlocking and/or cohesive connection to fasten the first and second metering units together.

12. The device for dispensing a fluid of claim 11, further comprising a third metering unit connected by a second connection element to one or both of the first metering unit and the second metering unit.

* * * * *